US005437541A

United States Patent [19]

Vainrub

[11] Patent Number: 5,437,541

[45] Date of Patent: Aug. 1, 1995

[54] BLADE FOR AXIAL FAN

[76] Inventor: John Vainrub, Apartado 80790, Caracas 1080A, Venezuela

[21] Appl. No.: 175,768

[22] Filed: Dec. 30, 1993

[51] Int. Cl.[6] ..... F01D 5/12

[52] U.S. Cl. ..... 416/223 R; 416/169 A; 416/195; 416/236 R

[58] Field of Search ..... 416/223 R, 169 A, 195, 416/234, 236 R; 415/119

[56] References Cited

U.S. PATENT DOCUMENTS

| | | | |
|---|---|---|---|
| 1,424,672 | 8/1922 | Ogrissek | 416/195 |
| 1,441,852 | 1/1923 | Heintz | 416/195 |
| 2,978,040 | 4/1961 | Wirkkala | 416/234 |
| 3,758,231 | 9/1973 | Barnstead | 416/230 |
| 4,505,641 | 3/1985 | Tsuchikawa et al. | 416/169 A |
| 4,610,601 | 9/1986 | Gerfast | 416/195 |
| 4,664,593 | 5/1987 | Hayashi et al. | 415/119 |
| 4,871,298 | 10/1989 | Vera | 416/169 A |
| 4,971,520 | 11/1990 | Van Houten | 416/169 A |
| 5,193,981 | 3/1993 | Scheidel et al. | 416/169 A |

*Primary Examiner*—John T. Kwon
*Attorney, Agent, or Firm*—Dowell & Dowell

[57] ABSTRACT

A blade for use in an axial fan includes a plurality of vanes which each have a winglet formed on their front face to increase the air flow of the fan at a given blade velocity.

18 Claims, 1 Drawing Sheet

BLADE FOR AXIAL FAN

BACKGROUND OF THE INVENTION

The present invention relates to a blade for use in an axial fan.

The present inventor has determined that most of the planes designed in the last decade have had an upwards bend, or winglet, at the end of the wings. Following some research, it was found that these winglets improve either the velocity of the airplane or the energy consumption at a given velocity.

Additional research was conducted to test different forms of winglets in a wind tunnel. The testing found that improvement was also obtained when winglets were applied to a ventilation fan.

The present application of winglets has previously not been known in this kind of axial fan, although winglets have been known in rotors for helicopters and for airplanes wings.

SUMMARY OF THE INVENTION

Through an experimental trial and error process, winglets were tested in different shapes, sizes and sectors of the blades of various axial fans.

In the wind tunnel of the lab in which testing was conducted, axial fans were installed in identical motors in a motor bank. All of the motors were set to operate at the same number of revolutions per minute. One of the axial fans installed in the motor bank did not have winglets.

Significant improvements of up to 25% additional cubic feet per minute were obtained in the axial fans including winglets in comparison to the axial fan without them.

Tests were performed a statistically significant number of times to obtain validation of the results.

BRIEF DESCRIPTION OF THE DRAWINGS

The invention is described hereinafter in conjunction with the following drawings, in which.

DETAILED DESCRIPTION OF THE PREFERRED EMBODIMENT

Figures 1, 2, 3, 4:
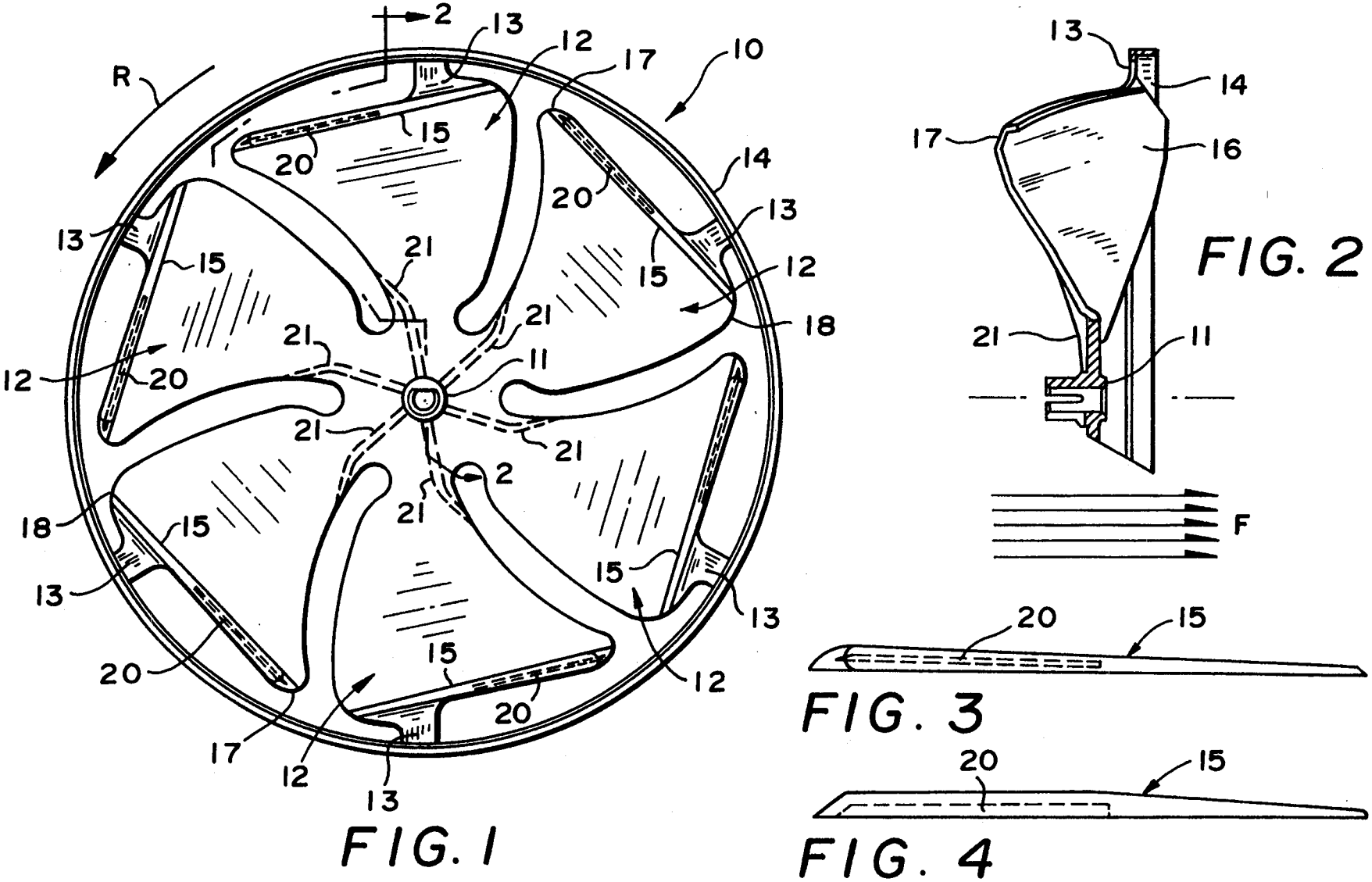
FIG. 1 is an axial front view of a blade in accordance with the preferred embodiment of the invention.
FIG. 2 is a sectional view along line 2—2 of FIG. 1.
FIG. 3 is an axial front view of a winglet of the blade of FIG. 1.
FIG. 4 is a side view of a winglet of the blade of FIG. 1.

With reference to the drawings, FIG. 1 is an axial front view of a blade 10 in accordance with the invention. The blade comprises a central hub 11 which is connected to a shaft of a motor (not shown) to rotate the blade as represented by the arrow R. A plurality of vanes 12 are integral with the central hub and extend radially outward from the hub. The vanes are each connected to a surrounding circular slinger ring 14 by a slinger ring support 13. As shown, the slinger ring supports 13 are disposed intermediate to the vanes and the slinger ring. The central hub 11, the vanes 12, the slinger ring supports 13 and the slinger ring 14 are formed as an integral structure.

In accordance with the invention, a winglet 15 is formed on the front face 16 of each vane 12 to increase the performance of the blade. As illustrated in FIG. 1, the winglets have a length so as to extend from the leading edge 17 to the trailing edge 18 of the vanes. The winglets 15 are each disposed at the outer edge 19 of the vane between its leading edge 17 and the associated slinger ring support 13. The winglets are spaced from the outer edge 19 between the trailing edge 18 and the slinger ring support 13.

As shown in FIG. 2, the winglets 15 extend outward from the front face 16 of the vanes 12 at approximately a right angle. Referring to FIG. 3, the thickness of each of the winglets decreases along its length from the leading edge 17 to the trailing edge 18. This configuration reduces the wind resistance. The air flow direction of the blade is represented by the arrows F. Referring to FIG. 4, the height of each of the winglets also decreases from the leading edge 17 to the trailing edge 18, to further reduce the wind resistance.

The winglets are provided on the vanes to increase the performance of the blade. More particularly, the winglets enable the blade to move an increased volume of air at a given revolution speed of the fan's motor.

The vanes 12 each have a groove 20 which is associated with a respective winglet. As shown in FIG. 1, the grooves extend along the length of each of the winglets between the leading edge 17 and the slinger ring support 13.

As illustrated in FIG. 2, a rib 21 is provided on the back face of each vane. The ribs 21 extend radially outward from the central hub 11 to the leading edge 17 of the vanes.

What is claimed is:

1. A blade for an axial fan comprising:

a central hub;

a plurality of vanes extending radially outward from said central hub, each of said plurality of vanes having a front face, a back face, a leading edge, a trailing edge, an outer edge, a winglet disposed on said front face and extending outwardly therefrom, said winglet having a length so as to extend along said outer edge, and said winglet having a width and a height which decrease along said length from said leading edge toward said trailing edge; and an outer ring being disposed radially outward from and being connected to said vanes.

2. The blade of claim 1, wherein each of said winglets extends outwardly from the front face of a vane at approximately a right angle.

3. The blade of claim 1, further comprising ring supports which connect said outer ring to said vanes, the ring supports being disposed closer to said trailing edge than to said leading edge of said vanes.

4. The blade of claim 3, wherein said winglets extend along said outer edge of said vanes between said leading edge and said ring supports, and said winglets are spaced from said outer edge between said ring supports and said trailing edge.

5. The blade of claim 1, wherein said blade elements each comprise a supporting rib disposed on said back surface, the supporting ribs extend radially outward from said central hub to said leading edge.

6. A blade for an axial fan comprising:

a central hub;

a plurality of vanes extending radially outward from said central hub, each of said plurality of vanes having a front face, a back face, a leading edge, a trailing edge, an outer edge, a winglet disposed on said front face and extending outwardly therefrom at approximately a right angle, said winglet having a length so as to extend along said outer edge, and said winglet having a width and a height which decrease along said length from said leading edge toward said trailing edge;

an outer ring being disposed radially outward from said vanes; and ring supports connecting said outer ring to said vanes.

7. The blade of claim 6, wherein said ring supports are disposed closer to said trailing edge than to said leading edge of said vanes.

8. The blade of claim 7, wherein said winglets extend along said outer edge of said vanes between said leading edge and said ring supports, and said winglets are spaced from said outer between said ring supports and said trailing edge.

9. The blade of claim 8, wherein said vanes each define a groove which extends along said length of said winglet between said leading edge and a ring support.

10. The blade of claim 9, wherein said blade elements each comprise a supporting rib disposed on said back surface, the supporting ribs extend radially outward from said central hub to said leading edge.

11. The blade of claim 10, wherein the blade has a unitary construction.

12. In an axial fan, a blade comprising:

a central hub;

a plurality of vanes extending radially outward from said central hub, each of said plurality of vanes having a front face, a back face, a leading edge, a trailing edge, an outer edge, and a winglet disposed on said front face and extending outwardly therefrom, said winglet having a length so as to extend along said outer edge, and said winglet having a width and a height which decrease along said length from said leading edge toward said trailing edge; and an outer ring being disposed radially outward from and being connected to said vanes.

13. The blade of claim 12, wherein each of said winglets extends outwardly from said front face of a vane at approximately a right angle.

14. The blade of claim 13, further comprising ring supports which connect said outer ring to said vanes, the ring supports being disposed closer to said trailing edge than to said leading edge of said vanes.

15. The blade of claim 14, wherein said winglets extend along said outer edge of said vanes between said leading edge and said ring supports, and said winglets are spaced from said outer between said ring supports and said trailing edge.

16. The blade of claim 15, wherein said vanes each define a groove which extends along said length of said winglet between said leading edge and a ring support.

17. The blade of claim 16, wherein said blade elements each comprise a supporting rib disposed on said back surface, the supporting ribs extend radially outward from said central hub to said leading edge.

18. The blade of claim 17, wherein the blade has a unitary construction.

* * * * *